United States Patent [19]

Merten

[11] 4,220,371

[45] Sep. 2, 1980

[54] METHOD OF MINERAL MINING PLOUGH OPERATION IN TWO DIRECTIONS OF VARYING DEPTH CUT

[75] Inventor: Gerhard Merten, Lunen, Fed. Rep. of Germany

[73] Assignee: Gewerkschaft Eisenhutte Westfalia, Lunen, Fed. Rep. of Germany

[21] Appl. No.: 35,707

[22] Filed: May 3, 1979

Related U.S. Application Data

[62] Division of Ser. No. 877,969, Feb. 15, 1978, Pat. No. 4,178,040.

[30] Foreign Application Priority Data

Feb. 23, 1977 [DE] Fed. Rep. of Germany ..... 2707724

[51] Int. Cl.[2] ..... E21C 27/34; E21C 41/00

[52] U.S. Cl. ..... 299/18; 299/34

[58] Field of Search ..... 299/18, 32, 34

[56] References Cited

U.S. PATENT DOCUMENTS 1,201,537 10/1916 Wisseman ..... 299/34 X 4,035,025 7/1977 Hermann et al. ..... 299/34

*Primary Examiner*—Ernest R. Purser

*Attorney, Agent, or Firm*—Thompson, Birch, Gauthier & Samuels

[57] ABSTRACT

A method of winning material in a mineral mining working utilizes a mineral mining plough which is movable to and fro alongside a conveyor. The plough is provided with first cutter means arranged to win material lying in a first height range, and second cutter means arranged to win material lying in a second height range. The plough is driven on the downhill run with the cutter means so positioned that material is won to a greater depth over the first height range than over the second height range. The plough is then driven on the uphill run with the cutter means so positioned that material is won to a smaller depth over the first height range than over the second height range.

5 Claims, 7 Drawing Figures

METHOD OF MINERAL MINING PLOUGH OPERATION IN TWO DIRECTIONS OF VARYING DEPTH CUT

This is a division of application Ser. No. 877,969 filed Feb. 15, 1978, now U.S. Pat. No. 4,178,040.

BACKGROUND TO THE INVENTION

This invention relates to a mineral winning plough for winning material in a mining working, and to a method of winning material in such a working. The invention is particularly concerned with a plough for, and a method of, winning different amounts of material on the "uphill" and "downhill" runs. Throughout this specification, the term "uphill" run should be taken to mean the ploughing run whose direction is opposed to that of the conveyor, along which the plough moves and the term "downhill" run should be taken to mean the ploughing run whose direction is the same as that of the conveyor.

SUMMARY OF THE INVENTION

It is known in the art to operate a plough on the uphill run with a larger depth of cut than on the downhill run, with a view to obtaining as even a loading of the longwall conveyor as possible with the best possible utilisation of the available driving output during the uphill and downhill runs. For example, it is known to operate a plough in such a way that on the uphill run a seam is first of all won in the central and upper area, and on the downhill run the seam section which has been left standing close to the floor is mined. In this case, the cutters operating during the downhill run are extended to give the same depth of out as the cutters which are operative during the uphill run. In such an operation, the plough cutters are so set that, on the downhill run, the working area and consequently the coal yield is considerably smaller than on the uphill run. Consequently, the power supplied to the plough is considerably smaller on the downhill run than on the uphill run, which leads to an unfavourable utilisation of the available driving power.

Coal ploughs are also known which have cutters which are set to give different depths of cut with a view to producing a preliminary (or stress-relieving) cut for a following cutter group. As far as such coal ploughs are concerned, it is also known to arrange the cutters on pivotal carriers so that, on the reversal of the ploughing run direction, they can swing between a working position and a rest position.

The aim of the invention is to provide a mineral winning plough for, and a method of, winning material in a mining working with which the loading on the conveyor is as even as possible, and with which the driving output of the plough drive is as even as possible during the uphill and downhill runs.

The present invention provides a method of winning material in a mineral mining working utilising a mineral mining plough which is movable to and fro alongside a conveyor, the plough having first cutter means arranged to win material lying in a first height range, and second cutter means arranged to win material lying in a second height range, the method comprising steps of driving the plough on the downhill run with the cutter means so positioned that material is won to a greater depth over the first height range than over the second height range, and then driving the plough on the uphill run with the cutter means so positioned that material is won to a smaller depth over the first height range than over the second height range.

This method avoids the uneven utilisation of power during the two ploughing runs since, on the downhill run, the plough can be operated with the first cutter means set to a depth of cut which is considerably larger than the depth of cut of the second cutter means during the uphill run.

With this ploughing method, it is possible to work the seam "true to profile", for example to produce, on each downhill run, a preliminary (stress-relieving) cut which facilitates the winning of material during the following uphill run. In this way the yield of fine material such as coal dust and small coal particles can also be greatly reduced.

Preferably, the first cutter means is arranged to win material to a greater depth when the plough is driven on the downhill run than when the plough is driven on the uphill run. In this case, the cutter means may be so arranged that the first cutter means, when the plough is driven on the downhill run, wins material to substantially the same depth as does the second cutter means when the plough is driven on the uphill run.

Alternatively, the first cutter means is arranged to win material to substantially the same depth when the plough is driven on either run. In this case, when the plough is driven on the downhill run, the first cutter means wins material to substantially twice the depth won by the second cutter means.

The invention also provides a mineral winning plough for winning material in a mineral mining working, the plough being movable to and fro alongside a conveyor and having a plough body provided with first cutter means arranged to win material lying in a first height range, and second cutter means arranged to win material lying in a second height range, wherein the first and second cutter means are mounted on the plough body in such a way that, when the plough is driven on the downhill run, the first cutter means wins material to a greater depth than the second cutter means, and, when the plough is driven on the uphill run, the second cutter means wins material to a greater depth than the first cutter means.

Preferably, both the first cutter means and the second cutter means are constituted by two sets of cutters, one set of cutters of each cutter means being operative to win material when the plough is driven on the downhill run, and the other set of cutters of each cutter means being operative to win material when the plough is driven on the uphill run.

Advantageously, said one set of cutters of the first cutter means is mounted on the plough body so as to win material to a greater depth than said other set of cutters of the first cutter means, and preferably, said one set of cutters of the first cutter means is arranged on an elongate carrier which is adjustably connected to the plough body by a parallelogram linkage.

The parallelogram linkage may be constituted by a pair of bars, one end of each bar being pivotally connected to the plough body, and the other end of each bar being pivotally connected to the carrier adjacent to the two ends thereof, said one set of cutters being arranged at one end of the carrier. In this case, the bar pivotally connected to the other end of the carrier may be provided with means for urging the carrier towards the face to be won when the plough is driven on the downhill run, and for urging the carrier away from said face when the plough is driven on the uphill run.

Preferably, said means is constituted by a cam-shaped toothed extension of that bar, the cam-shaped portion constituting said means for urging the carrier away from said face, and the toothed portion constituting said means for urging the carrier towards said face. The bar provided with the cam-shaped, toothed extension may be shorter than the other bar.

Where a preliminary cut is required near to the floor of the working, the first cutter means is arranged at the base of the plough body.

The plough may further comprise a second plough body provided with third and fourth cutter means, the third cutter means being arranged to win material over the first height range, and the fourth cutter means being arranged to win material over the second height range.

Advantageously, both the third cutter means and the fourth cutter means are constituted by two sets of cutters, one set of cutters of each cutter means being operative to win material when the plough is driven on the downhill run, and the other set of cutters of each cutter means being operative to win material when the plough is driven on the uphill run. The fourth cutter means may be arranged to win material to the same depth as the second cutter means, and the third cutter means may be arranged to win material to the same depth as said other set of cutters of the first cutter means.

Preferably, the two sets of cutters of the third cutter means are each mounted on a respctive support which is pivotally mounted on the second plough body for limited pivotal movement relative thereto, the two supports being joined together by means of a mechanical linkage whereby said one set of cutters of the third cutter means is pivoted into its operative position when the plough is driven on the downhill run, and said other set of cutters is pivoted into its operative position when the plough is driven on the uphill run.

BRIEF DESCRIPTION OF THE DRAWINGS

The invention will now be described in greater detail, by way of example, with reference to the accompanying drawings, in which.

DESCRIPTION OF PREFERRED EMBODIMENT

Figure 1:
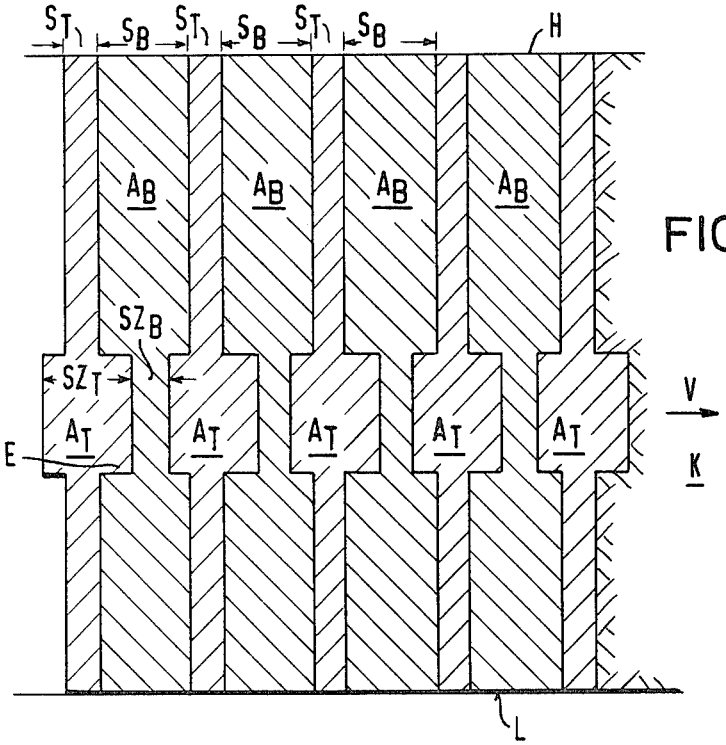
FIGS. 1 to 4 show different cutting profiles of a coal plough constructed in accordance with the invention.
Figure 5:
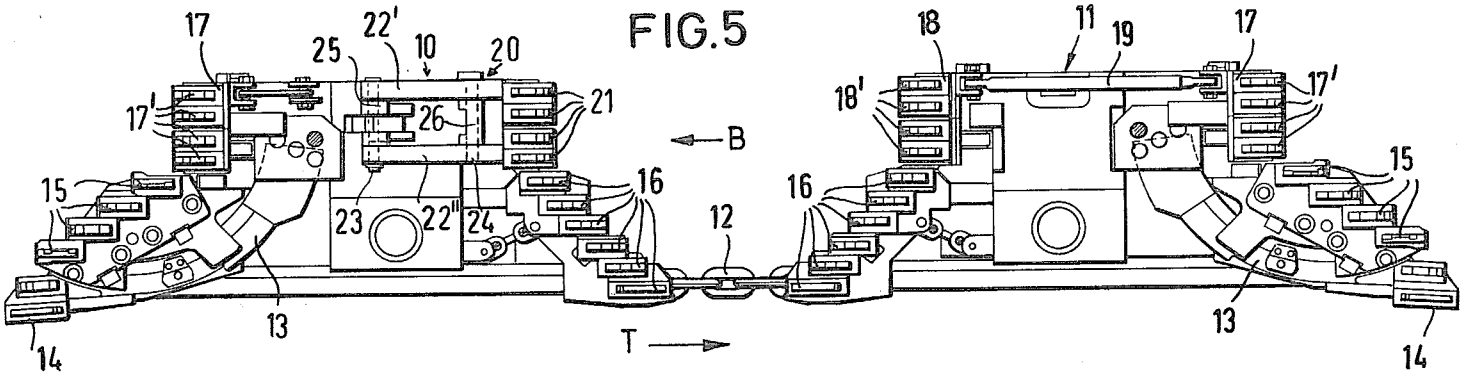
FIG. 5 is a view from the coal face of a coal plough constructed in accordance with the invention.
Figure 7:
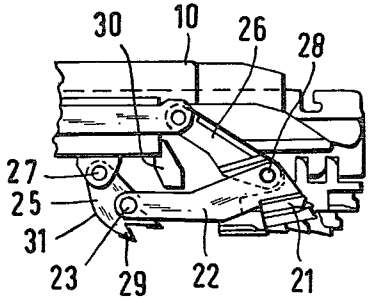
FIG. 7 is a partial plan view similar to FIG. 6 but showing a different operating condition.
Figure 6:
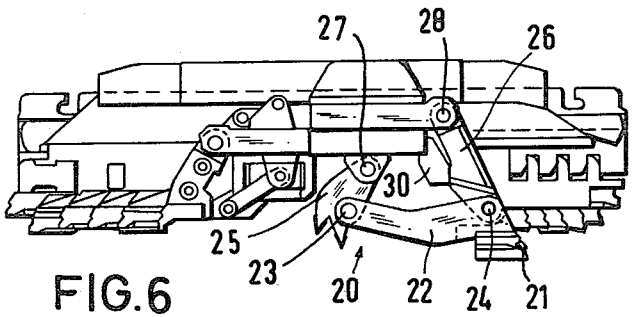
FIG. 6 is a plan view of part of the plough of FIG. 5.

Referring to the drawings, FIG. 1 shows a cutting profile of a coal plough constructed in accordance with the invention. The plough, which is described below with reference to FIGS. 5 to 7 is provided with a swordplate (not shown) extending under the conveyor and which is driven by a plough chain which is guided on the goaf side of the longwall conveyor. The coal face to be won is indicated by K, the floor of the working by L, the roof by H and the arrow V indicates the direction of face advance. The panels $A_T$ designate the cutting profile (or the area mined) by the plough on the downhill run, whereas the panels $A_B$ represent the cutting profile (or the area mined) by the plough on the uphill run. It will be seen that the area of each of the panels $A_B$ is considerably larger than the area of each of the panels $A_T$. A considerably larger quantity of coal is, therefore, mined during the uphill run of the plough than during the downhill run. On the downhill run the main cutters of the plough operate with a depth of cut $S_T$ which is considerably smaller than the depth of cut $S_B$ of the main cutters during the uphill run. The coal plough is also provided with auxiliary cutters which during the downhill run operate with a depth of cut $SZ_T$ which corresponds to the depth of cut $S_B$, and which is appreciably larger than the depth of cut $S_T$. On each downhill run there is, therefore, a preliminary (or stress-relieving) cut E made by these auxiliary cutters approximately in the central seam area.

This preliminary cut E facilitates the mining during the following uphill run. The height and depth of the preliminary cut E is determined in accordance with the depth of cut of the various cutters in such a way that the power requirement of the coal plough during the downhill run approximately equals the power requirement during the uphill run. The actual position of the preliminary cut E is determined, among other things, by the actual seam profile and the type of plough used.

It can also be seen from FIG. 1 that the auxiliary cutters operate during the uphill run with a depth of cut $SZ_B$ which is considerably smaller than the depth of cut $SZ_T$ during the downhill run, and which is approximately equal to the depth of cut $S_T$ of the main cutters.

Figure 2:
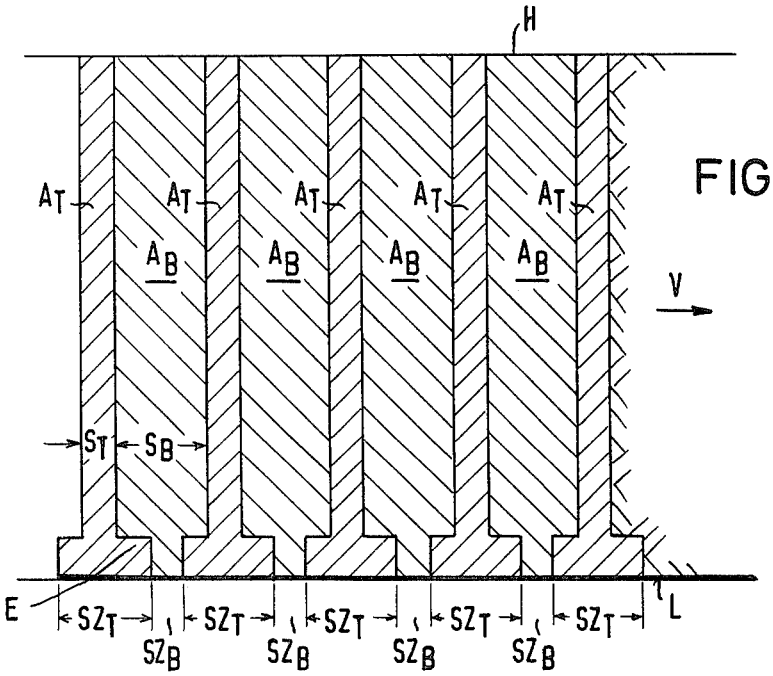

FIG. 2 shows a cutting profile which is similar to that of FIG. 1 in that the depths of the cuts $S_T$, $S_B$, $SZ_B$ and $SZ_T$ are the same as for FIG. 1. The essential difference, as compared with the cutting profile of FIG. 1, is that the preliminary cut E is here produced adjacent to the floor of the working.

Figure 3:
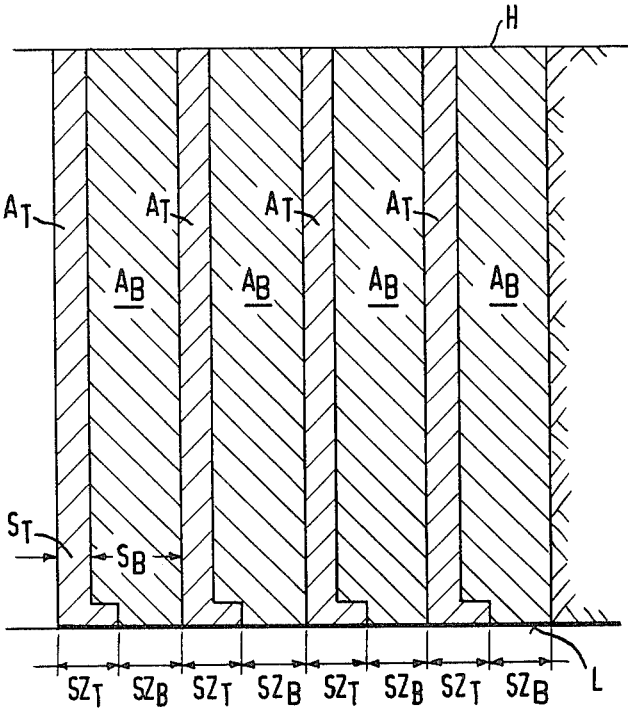

The cutting profile shown in FIG. 3 is similar to that of FIG. 2 in that the preliminary cut E is again produced in the floor region of the working. Here, however, the depths of the cuts $S_T$, $S_B$, $SZ_B$ and $SZ_T$ are different. Thus, the depth of the cut $SZ_T$ is about twice the depth of the cut $S_T$. Moreover, the depth of cut $SZ_T$ of the auxiliary cutters on the downhill run equals the depth of cut $SZ_B$ of these cutters on the uphill run.

Figure 4:
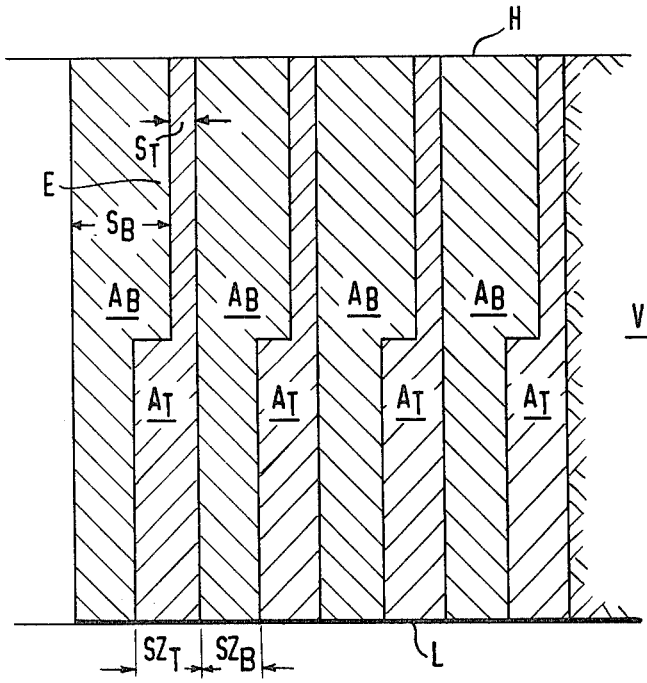

FIG. 4 shows a cutting profile which is similar to that of FIG. 3 in that the depth of the cuts $S_T$, $S_B$, $SZ_T$ and $SZ_B$ are similar. Here, however, during the uphill run there is produced by the main cutters a preliminary cut E which extends to the depth of cut $S_B$, this preliminary cut extending over the upper seam area. On the following downhill run the preliminary cut E is deepened by the main cutters by a depth of cut $S_T$. At the same time, on the downhill run, the lower seam area is deepened by the auxiliary cutters by a depth of cut $SZ_T$.

In the exemplary cutting profiles described above, it is possible that the cuts of the main and auxiliary cutter are in each case produced by groups of cutters each of which may be pivotally arranged on the plough body.

FIGS. 5 to 7 show, in detail, a plough constructed in accordance with the invention. The plough comprises two plough bodies 10 and 11 which are flexibly connected by means of a chain section 12. Each plough body 10 and 11 is guided on a guide (not shown) which is attached to a longwall conveyor (not shown) on the coal face side. Each of the plough bodies 10 and 11 is provided with a pivotally mounted carrier 13 which supports floor cutters 14. Each plough body 10 and 11 is also provided, on their opposite sides, with fixed main cutters 15 and 16 arranged in an echelon formation one above the other. The plough body 11 is also provided with carriers 17 and 18 which are pivotally mounted thereto and which are inter-connected by means of a mechanical linkage 19. The carriers 17 and 18 support auxiliary cutters 17' and 18' which are located above the main cutters 15 and 16. The carriers 17 and 18 are arranged to bring their cutters 17' and 18' into an operative position when they constitute leading cutters, and into an inoperative position when they constitute lagging cutters. The plough body 10 is also provided with a pivotally mounted carrier 17 provided with auxiliary cutters 17' which lie above the main cutters 15. Unlike the plough body 11, however, the plough body 10 is provided with a carrier 20 mounted above the main cutters 16 and provided with auxiliary cutters 21. As can best be seen in FIG. 6, the carrier 20 is constituted by a coupling rod 22, one end of which carries the auxiliary cutters 21. At its two ends, the rod 22 is coupled to guide bars 25 and 26 by means of pivot joints 23 and 24. The other ends of these two guide bars 25 and 26 are connected to the plough body 10 by means of pivot joints 27 and 28. The rod 22 and the bars 25 and 26 thus form a parallelogram linkage with the plough body 10. The shorter guide bar 25 is connected to the free end of the coupling rod 22, and the longer guide bar 26 is connected to the end of the coupling rod which is provided with the auxiliary cutters 21. As a result of the parallelogram linkage, a parallel displacement of the cutters 21 is caused by swinging the coupling rod 22 out towards the coal face. FIG. 6 shows the linkage with the cutters 21 swung out into their operative position, the longer guide bar 26 being supported at the rear on an adjustable stop 30, and FIG. 7 shows the linkage with the auxiliary cutters in their inoperative position. The shorter guide bar 25 is provided with a cam-shaped profile 31 and a toothed end portion 29. The toothed portion 29 holds the linkage in with the auxiliary cutters in their operative position by co-operation with the coal face during the downhill ram, and the cam 31 forces the linkage away from the face during the uphill run so that the auxiliary cutters are inoperative.

The cutters 15, 16, 17', 18' and 21 of the coal plough described above are set in such a manner that, on the downhill run in the direction of the arrow T (see FIG. 5), the leading cutters 15 of the plough body 11 and the leading cutters 16 of the plough body 10 jointly produce a cut to the depth $S_T$, and the auxiliary cutters 21 and the auxiliary cutters 17' of the plough body 11 jointly produce a cut to the depth $SZ_T$. The leading cutters 17' of the plough body 11 mine the coal face to a depth of cut $SZ_B$, the face then being cut to the final depth of cut $SZ_T$ by the cutters 21 of the plough body 10.

On the uphill run in the direction of the arrow B, the leading cutters 15 of the plough body 10 and the leading cutters 16 of the plough body 11 jointly mine the coal face to a depth of cut $S_B$, and the auxiliary cutters 18' of the plough body 11 enlarge the preliminary cut E produced during the downhill run, by a depth of cut $SZ_B$ (see for example FIG. 1), the carrier 20 being swung back during the uphill run so that the auxiliary cutters 21 are inoperative.

The parallelogram linkage described above is particularly suitable for the use with a plough of the type described since it enables the auxiliary cutters 21 to be extended to give a comparatively large depth of cut. It is, of course, possible to place on the two plough bodies 10 and 11 or on a bridge joining them, further main cutters for mining the coal above the blades 17', 18' and 21 according to the desired cutting profile. In the coal plough described above the blades 17', 18' and 21 jointly form the auxiliary cutters which, on the downhill run produces a cut with a depth of $SZ_T$, and, on the uphill run, produce a cut with a depth of $SZ_B$. The other cutters 15 and 16 form the main cutters, which, on the downhill run, operate with a depth of cut $S_T$ and, on the uphill run, with a depth of cut $S_B$.

It will be understood that the carrier 20 together with its auxiliary cutter 21 could be located on the plough in different vertical positions. In this case, the other auxiliary cutters 17' and 18' would be positioned at the same height as the cutters 21. It is also possible to provide several such carriers 20 on the plough.

As can be seen in FIG. 5, the coupling rod 22 actually consists of two parallel rods 22' and 22'', arranged one above the other, the ends of these rods 22' and 22'' being connected by means of the pivot joints 23 and 24 and the guide bars 25 and 26. All the pivot joints 23,24, 27 and 28 have parallel vertical pivot axes.

I claim:

1. A method of winning material in a mineral mining working utilising a mineral mining plough which is movable to and fro alongside a conveyor, the plough having first cutter means arranged to win material lying in a first height range, and second cutter means arranged to win material lying in a second height range, the method comprising the steps of driving the plough on the downhill run with the cutter means so positioned that material is won to a greater depth over the first height range than over the second height range, and then driving the plough on the uphill run with the cutter means so positioned that material is won to a smaller depth over the first height range than over the second height range.

2. A method according to claim 1, wherein the first cutter means is arranged to win material to a greater depth when the plough is driven on the downhill run than when the plough is driven on the uphill run.

3. A method according to claim 2, wherein the cutter means are so arranged that the first cutter means, when the plough is driven on the downhill run, wins material to substantially the same depth as does the second cutter means when the plough is driven on the uphill run.

4. A method according to claim 1, wherein the first cutter means is arranged to win material to substantially the same depth when the plough is driven on either run.

5. A method according to claim 4 wherein, when the plough is driven on the downhill run, the first cutter means wins material to substantially twice the depth won by the second cutter means.

* * * * *